United States Patent [19]

Stewart et al.

[11] Patent Number: 4,485,658

[45] Date of Patent: Dec. 4, 1984

[54] CARRIAGE ASSEMBLY FOR A TUBE BENDING MACHINE

[76] Inventors: A. K. Stewart; John H. Hewitt, both of c/o Teledyne Pines, 601 W. New York St., Aurora, Ill. 60506

[21] Appl. No.: 499,779

[22] Filed: May 31, 1983

[51] Int. Cl.[3] ..... B21D 7/04

[52] U.S. Cl. ..... 72/149; 72/305; 72/307; 72/310

[58] Field of Search ..... 72/149–159, 72/305–307, 310, 384, 442, 477; 29/33 J, 33 T

[56] References Cited

U.S. PATENT DOCUMENTS

| | | | |
|---|---|---|---|
| 2,709,473 | 5/1955 | Grace et al. | 72/154 X |
| 3,017,917 | 1/1962 | Streit | 72/310 |
| 3,373,587 | 3/1968 | Shubin et al. | 72/158 |
| 3,974,676 | 8/1976 | Eaton | 72/307 |
| 4,112,728 | 9/1978 | Noack et al. | 72/154 |
| 4,201,073 | 5/1980 | Eaton | 72/155 |
| 4,313,324 | 2/1982 | Pearson | 72/149 |

FOREIGN PATENT DOCUMENTS

| | | | |
|---|---|---|---|
| 1962590 | 6/1971 | Fed. Rep. of Germany | 72/157 |
| 2121756 | 8/1972 | France | 72/384 |

OTHER PUBLICATIONS

Brochure, Pines Model 1400 Bending Machine.

*Primary Examiner*—E. Michael Combs
*Attorney, Agent, or Firm*—Wood, Dalton, Phillips, Mason & Rowe

[57] ABSTRACT

A tube bending machine is provided having a longitudinal base and a dual bend head. A carriage having a tube grasping collet is supported by a ball screw and a rotatable shaft, both of which lie longitudinally along the machine base. The ball screw extends through a nut fixed to the carriage and the rotatable shaft is drivably connected to the collet. The shaft is securable in two different positions to present a tube to the bend head for either right-hand or left-hand bending.

20 Claims, 8 Drawing Figures

FIG. 1
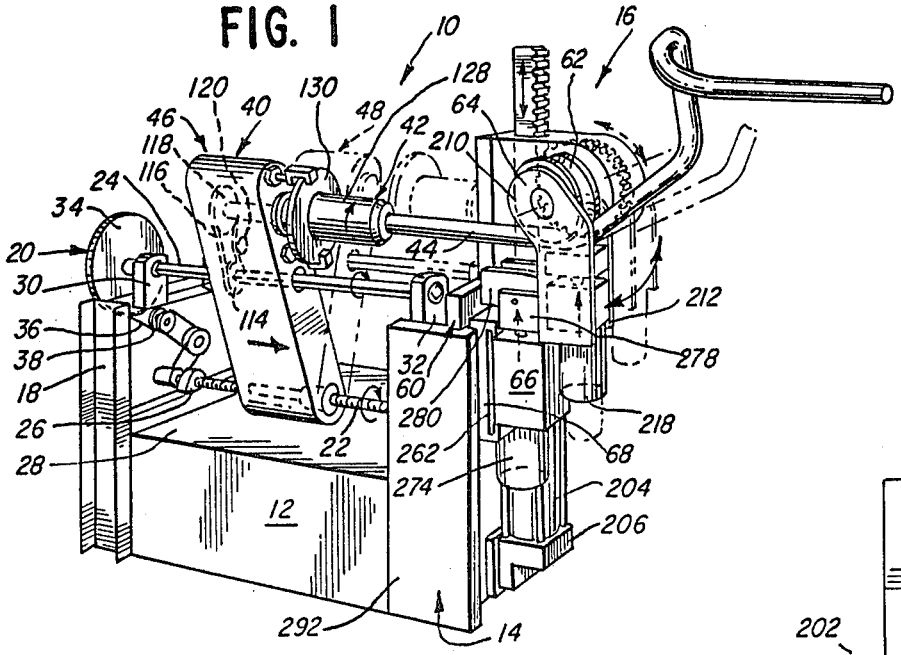
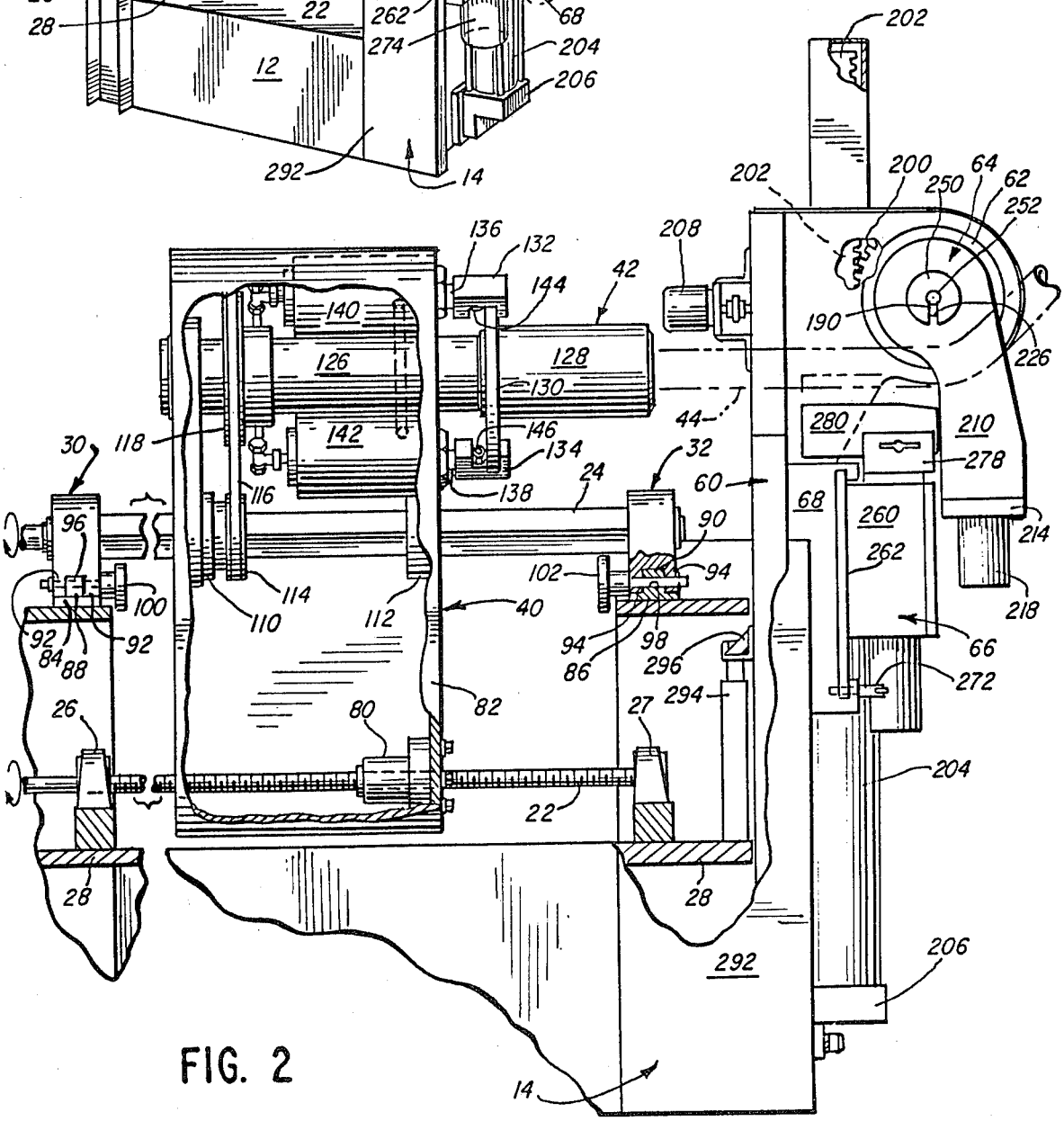
FIG. 2

FIG. 3
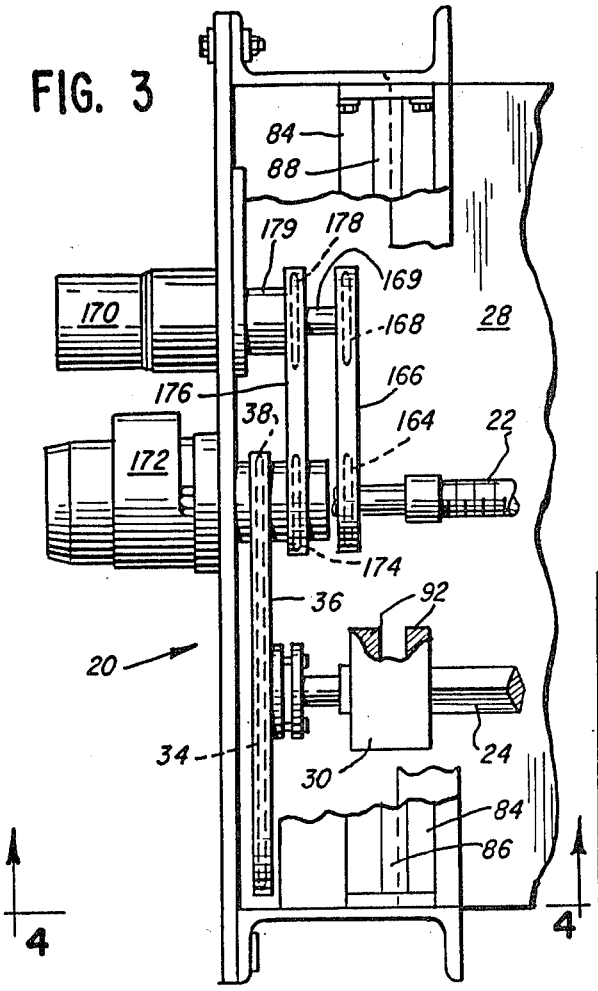
FIG. 6
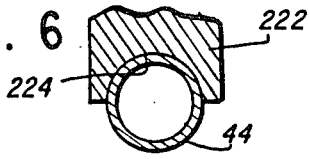
FIG. 5
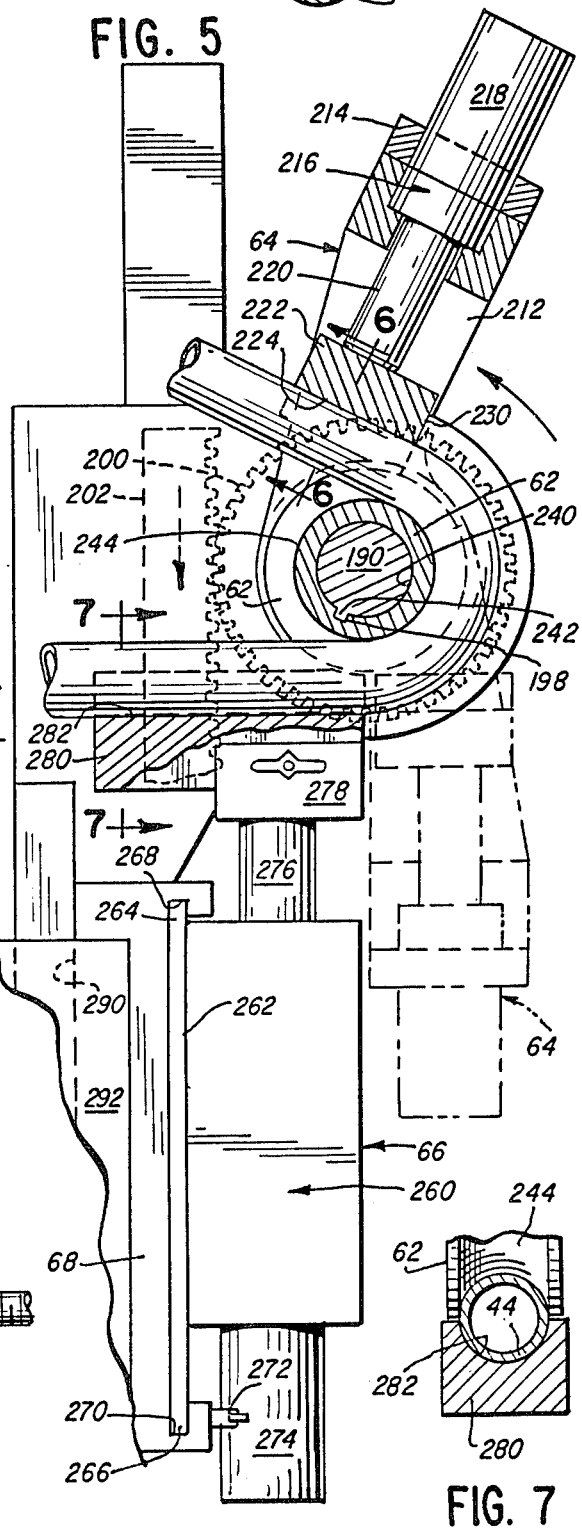
FIG. 4
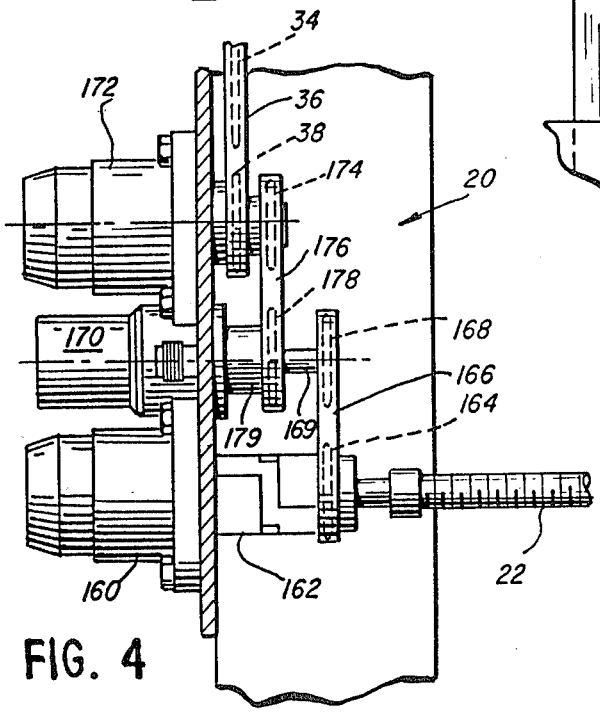
FIG. 7

CARRIAGE ASSEMBLY FOR A TUBE BENDING MACHINE

DESCRIPTION

TECHNICAL FIELD

This invention relates to a tube bending machine and more particularly to a carriage drive assembly for a dual bend head machine.

BACKGROUND ART

Tube bending machines having carriages which grasp a tube and position and orient the tube at a bend head are known in the art. Such carriages typically move the tube longitudinally to position the desired segment for bending and also rotate the tube to orient it so that bending will occur in the proper plane.

However, because some tube configurations during bending are such that a particular bend would be prevented since it would require that the forward part of the tube be moved through space occupied by the machine, some bending machines have dual bend heads which permit bending of the tube to take place on either side of the machine. Machines with such dial bend heads have thus required a carriage structure which is capable of orienting a tube along two different axes for bending, one axis for each set of bend components of the dual bend head.

One structure which has been used provides a dual carriage with duplicate parts associated with each of the bend axes. This structure requires duplication of numerous parts and is thus expensive. Another structure which has been used provides a carriage on a track, which track is adapted so that it may be moved to align with either of the axes. Such a structure is shown in U.S. Pat. No. 4,201,073. Changing a carriage on such a track from one axis to the other is difficult and unwieldy. Further, such structures often do not provide parallel bend axes as is desirable.

Still another structure which has been used supports the carriage on one side a central track and the track and carriage are pivoted 180° between bend axes defined on diametrically opposite sides of the track. Such a structure is shown in U.S. Pat. No. 4,313,324. However, such structures when automatically pivoted between axes require costly components for accomplishing the pivoting. Further, pivoting the carriage and track manually is difficult and unwieldy since the operator must lift the carriage and then push it laterally across the top to the other side.

The present invention is directed toward overcoming one or more of the problems as set forth above.

SUMMARY OF THE INVENTION

In one aspect of the present invention, a tube bending machine is provided having a longitudinal base and a dual bend head. A carriage having a tube grasping collet is supported by a ball screw and a rotatable shaft, both of which lie longitudinally along the machine base. The ball screw extends through a nut fixed to the carriage and the rotatable shaft is drivably connected to the collet. The shaft is securable in two different positions to present a tube to the bend head for either right-hand or left-hand bending.

The present invention provides an inexpensive structure in which a carriage is supported to move a tube both longitudinally and rotationally with respect to either of two bend positions of a dual bend head. This simple yet effective structure both supports the carriage and drives the carriage in presenting the tube in the proper orientation at the bend head, thereby minimizing the separate components of the structure to maximize its reliability and minimize its cost. Still further, the carriage structure is such that it may easily be manually oriented and locked by the operator in either of the two bend positions with a minimum of effort.

BRIEF DESCRIPTION OF THE DRAWINGS

FIG. 1 is a perspective view of the tube bending machine;

FIG. 2 is a partially broken side view of the tube bending machine;

FIG. 3 is a top view of the carriage drive mechanism of the tube bending machine;

FIG. 4 is a view taken along line 4—4 of FIG. 3;

FIG. 5 is a cross-sectional side view of the bend head of the tube bending machine;

FIG. 6 is a cross-sectional view taken along line 6—6 of FIG. 5;

FIG. 7 is a cross-sectional view taken along line 7—7 of FIG. 5.

DESCRIPTION OF THE PREFERRED EMBODIMENT

Figure 8:
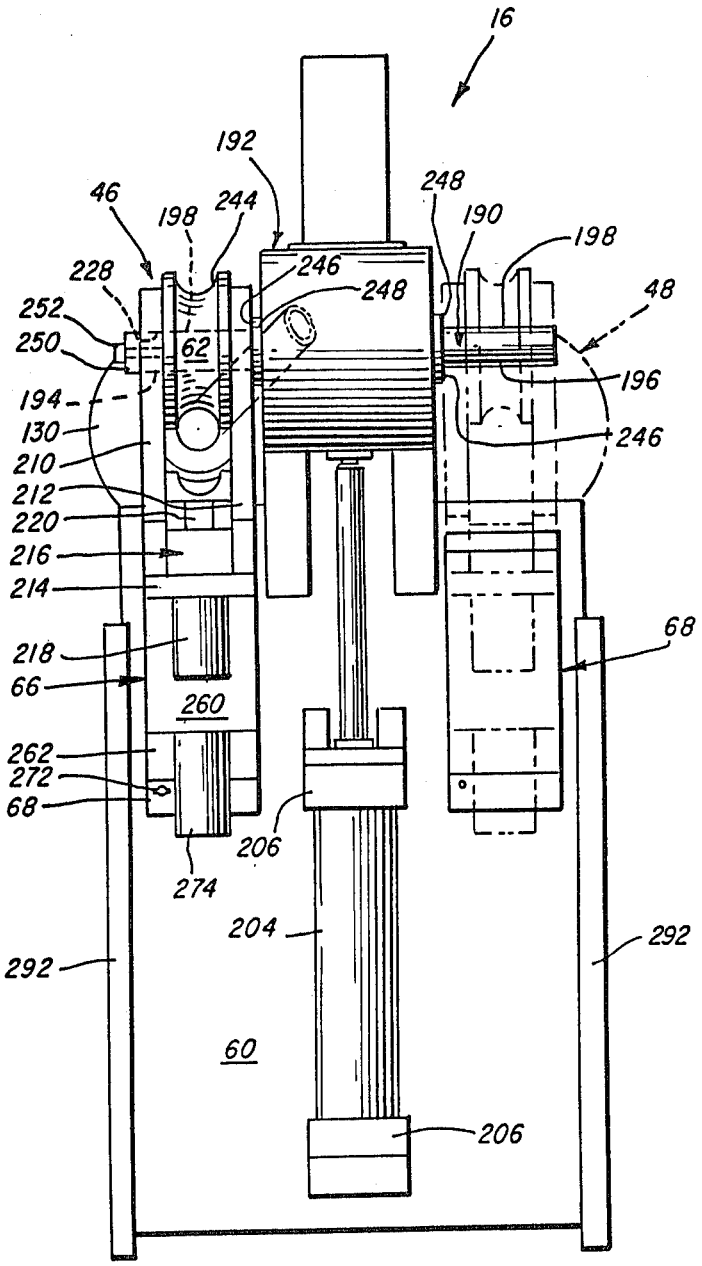
FIG. 8 is a front view of the bend head of the tube bending machine.

The tube bending machine 10 is shown in perspective in FIG. 1. Many of the covers and shields are not shown in this view in order to best illustrate the machine 10, however, suitable covers are desirable and should be provided to protect both the machine components and the machine operator.

The tube bending machine 10 includes a longitudinal base 12 having at its forward end a support structure 14 for the bend head 16 and having at its rear end a support structure 18 for the carriage drive mechanism 20. Supported between the forward and rear support structures 14,18 are a ball screw 22 and a square shaft 24. The ball screw 22 is supported by bearing mounts 26,27 which are supported on a bottom base plate 28 (see also FIG. 2) so that the ball screw 22 extends along the transverse center of the machine 10. The square shaft 24 is rotatably supported by rear and front brackets 30,32 which are releasably secured to the front and rear support structures 14,18. A driven sprocket gear 34 is connected to the square shaft 24 and connected by a chain 36 to a drive sprocket gear 38 to rotatably drive the square shaft 24.

Supported on the ball screw 22 and square shaft 24 is a carriage 40 which has a collet 42 thereon for grasping and supporting a tube 44 for bending. As can be seen, the carriage 40 includes three longitudinal openings for the ball screw 22, the square shaft 24 and the collet 42 respectively. The brackets 30,32 supporting the square shaft 24 can be detached from the support structures 14,18 and reattached to the other side of the support structures 14,18, thereby pivoting the carriage 40 and collet 42 between the first bending position 46 as shown and the second bending position 48 shown in phantom (see also FIG. 8).

It is desirable to provide two bending positions on opposite sides of the machine 10 to avoid possible machine/tube interference. The configurations of some tubes when bent are such that a particular bend would be prevented because it would require that the forward part of the tube be moved through space occupied by the machine 10. To minimize this possibility, the bend head 16 is arranged to permit bending to occur on either side of the machine 10 (known as right or left-hand bending) without unnecessarily duplicating components in the bend head 16.

The bend head 16 is supported on a face plate 60 which is adjustably supported (as detailed hereinafter) by the front support structure 14 so that it may be raised or lowered (depending upon the radius of the bend die 62 as will be apparent). The bend head 16 includes a bend die 62 with a bend arm 64 supported for rotation with the bend die 62. A pressure die assembly 66 is releasably mounted to a holder 68 on the face plate 60 beneath the bend die 62.

The various components described generally above are described in further detail hereafter with reference to the other figures.

Referring now to FIG. 2, the ball screw 22 extends through the bottom of the carriage 40 and through a suitable nut 80 mounted within the carriage body 82. The square shaft 24 also extends through the carriage body 82 and is supported by the brackets 30,32 fixed to transverse beams 84,86 having upright flanges 88,90 across the support structures 14,18. Each bracket 30,32 includes two legs 92,94 defining a U groove within which the corresponding upright flange 88,90 may be received. Two sets of holes 96,98 are provided in the flanges 88,90, respectively, at locations equidistant from and on either side of the transverse center of the machine 10 (only one set of holes can be seen in FIG. 2). With each bracket 30,32, a pin 100,102 is extended through the holes in the bracket legs 92,94 and the appropriate flange hole 96,98 to lock the brackets 30,32 and accordingly the square shaft 24 and carriage 40 in either the first or second bending positions 46,48.

Suitable bearings 110,112 are provided at both the front and the rear of the carriage body 82 to support the carriage body 82 with respect to the axis of the square shaft 24 while still permitting the square shaft 24 to rotate and the carriage body 82 to slide along the square shaft 24. A sprocket 114 is supported by the rear bearing 110 and is over the square shaft 24 so that it will rotate with and slide over the shaft 24. The sprocket 114 drives a chain 116 which in turn drives a collet sprocket 118. An idler sprocket 120 (see FIG. 1) is also provided to maintain the proper tension on the chain 116.

The collet sprocket 118 is fixed to the tube grasping collet assembly 126 which includes the collet 42 previously mentioned. The collet assembly 126 is rotatably journalled within the carriage body 82 by suitable means and includes a tubular opening through its length through which a tube 44 for bending may be extended. The tube 44 within the collet assembly 126 is grasped by any suitable means, as for example by collet fingers which are biased together by an axially movable actuator 128. The collet fingers are not seen in FIG. 2 but such assemblies are common in this art whereby the actuator 128 has a cam surface which forces the collet fingers together when biased axially over the fingers.

The actuator 128 has an annular flange portion 130 which is supported between two grips 132,134. The grips 132,134 are fixed to the rods 136,138 of pneumatic cylinders 140,142 secured within the carriage body 82 so that they may be axially biased to thereby bias the actuator 128 as well for grasping or releasing a tube 44. The grips 132,134 have suitable bearings 144,146 to permit the flange portion 130 and actuator 128 to rotate.

Operation of the carriage 40 accordingly is as follows. The square shaft 24 is fixed to the support structures 14,18 in the desired of the two bending positions 46,48, depending principally upon the intended configuration of the tube 44. A tube 44 is extended through the collet assembly 126 and the pneumatic cylinders 140, 142 are energized to bias the actuator 128 forward to force the collet fingers together to securely grasp the tube 44.

The ball screw 22 may then be rotated to move the carriage 40 and tube 44 axially forward to align the tube 44 in the bend head 16 for bending. The square shaft 24 may also be rotated, thereby driving the belt 116 and rotating the collet assembly 126 (including the actuator 128) and grasped tube 44 to rotationally align the tube 44 for bending as well.

To change from one bending position 46 or 48 to another bending position 48 or 46, as when a tube having a new configuration is to bent which will require bending on the opposite side of the machine 10, the pins 100,102 are removed from the brackets 30,32. The operator then can give a sideways push to the carriage 40 to pivot it to the other side of the base 12 and then reinsert to pins 100,102 to thereby lock the brackets 30,32 and shaft 24 in position on the other side of the base 12.

The carriage 40 is supported in either of its bending positions 46,48 so that it is tilted no greater than 45° from vertical, preferably 30° or less. This results in the center of gravity of the carriage 40 being close to the screw 22 about which the carriage 40 pivots and, together with the large moment arm presented by the height of the carriage 40, minimizes the force required to move the carriage 40 from one bending position 46 or 48 to the other. An operator can easily move the carriage 40 between bending positions 46,48 by pushing sideways on the top of the carriage 40 without being required to do any lifting.

FIGS. 3 and 4 show the carriage drive mechanism 20 for the ball screw 22 and square shaft 24. FIG. 3 shows the rear support structure 18 from the top and FIG. 4 shows the structure 18 from the side. A screw motor 160 (FIG. 4) rotates a shaft 162 which is directly coupled to the ball screw 22. The shaft 162 also includes a sprocket gear 164 which drives a chain 166 looped over one sprocket gear 168 on the first shaft 169 of a two shaft encoder 170. The encoder 170 measures the rotation of its one sprocket 168 to determine the axial position of the carriage 40 when, for example, the machine has a numerical control unit.

A shaft motor 172 (FIGS. 3 and 4) located in the transverse center of the machine 10 and thus directly above the screw motor 160, rotates the drive sprocket gear 38 which drives the chain 36 looped over the large driven sprocket gear 34 fixed to the square shaft 24 (see also FIG. 1) to thereby rotatably drive the square shaft 24.

Since the shaft motor 172 is centrally located, it is equidistant from the first and second bending positions 46,48 of the square shaft 24. Also, since the shaft motor 172 is vertically aligned with the ball screw 22 about which the carriage 40 pivots, the maximum distance between the driven and drive sprocket gears 34,38 is at those first and second positions 46,48. Accordingly, the chain 36 will be taut in either of the bending positions though it will have some slack when the carriage 40 is pivoted between positions 46,48.

The shaft motor 172 also drives another sprocket gear 174 which drives a chain 176 looped over a second sprocket gear 178 on the second shaft 179 of the encoder 170. The encoder 170 measures the rotation of its second sprocket gear 178 to determine the rotational position of the collet assembly 126 and its grasped tube 44.

The bend head 16 will now be described with reference to FIGS. 1, 2 and 5–8. A bend shaft 190 extends transversely through a center drive assembly 192 with an end 194,196 projecting out either side (see FIG. 8). Both ends 194,196 of the bend shaft have key flanges 198 (see FIGS. 5 and 8). The bend shaft 190 is fixed by suitable means to a gear 200 (see FIG. 5) within the center drive assembly 192, which gear 200 is driven by a rack 202 which is vertically reciprocable and driven by a center hydraulic cylinder 204 supported by brackets 206 on the face plate 60. An encoder 208 is also provided (see FIG. 2) to measure the vertical motion of the rack 202 to determine the rotational position of the bend die 62 and bend arm 64.

The bend arm 64 comprises two arm members 210, 212 interconnected at the bottom by a cross plate 214 and supporting a clamp die assembly 216. The clamp die assembly 216 includes a hydraulic cylinder 218 suitably mounted between the arm members 210,212 and to the cross plate 214. Though the cylinder 218 is shown to be rigidly mounted, it may alternatively be spring mounted to the bend arm 64 to provide some flexibility when it is pressurized.

The cylinder 218 reciprocates a rod member 220 which on its end supports a clamp die 222. The clamp die 222 has a linear groove 224 with a semi-circular crosssection and thus a number of clamp dies may be used depending upon the radius of the tube 44 being bent. A suitable clamp die mount (not shown) may be provided at the end of the rod member 220 to permit mounting of whichever clamp die is desired.

The two arm members 210,212 are parallel and have aligned circular openings 226 at the upper end with key slots 228. The hydraulic cylinder 218 is supported by the bend arm 64 with its axis off center to support the clamp die 222 so that its rear edge 230 is radially aligned with the bend shaft 190 as is known for clamp dies.

The bend die 62 fits between the arm members 210,212 and also has a circular opening 240 with a key slot 242 so that, together with the arm members 210,212, it will slide over the bend shaft 190 and key flange 198 and rotate with the shaft 190. The bend die 62 has an annular groove 244 with a semi-circular cross-section, and thus different bend dies are used depending both on the radius of the tube 44 to be bent and the desired radius of the bend for the tube 44. The bend die 62 shown in FIG. 5 for example has a smaller bend radius than the bend dies shown in the other figures. Accordingly, the bend arm 64 and bend die 62 may be easily mounted to either end 194,196 of the bend shaft 190 by merely sliding the bend arm 64 and appropriate bend die 62 over either end 194,196 until the arm member 212 or 210 abuts the shoulder 246 of an enlarged portion 248 of the bend shaft 190 (see FIG. 8). Any suitable means may be used to retain the bend arm 64 and bend die 62 on the bend shaft 190, as for example by fixing a plate 250 on the end 194,196 of the bend shaft 190 by a bolt 252.

The pressure die assembly 66 includes a mounting structure 260 having a plate 262 with upper and lower extending flanges 264,266. A pair of holders 68 are secured to opposite sides of the face plate 60, each of which define facing upper and lower grooves 268,270, which grooves 268,270 are spaced apart a distance equal to the vertical height of the mounting structure plate 262. Accordingly, the pressure die assembly 66 may be mounted for either of the bending positions 46,48 by merely sliding the mounting structure plate 262 into the grooves 268,270 of the appropriate holder 68 from the side. A locking screw 272 may be provided with the holder 68 so as to secure the mounting structure plate 262 to the holder 68.

The mounting structure 260 of the pressure die assembly 66 supports a hydraulic cylinder 274 having a rod 276 which has a pressure die mount 278 secured to its end. The cylinder 274 is shown as being rigidly mounted, though it may also be spring mounted. A pressure die 280 with an appropriate linear groove 282 (depending on the radius of the tube 44 to be bent) is mounted to the pressure die mount 78.

The tube 44 must be presented by the carriage 40 so as to be tangential to the bend die groove 244 for proper operation of the machine 10 to take place. However, bend die of different radii are used for different tubes and tube configurations, and thus the bend shaft 190 must be vertically adjustable to enable each bend die 62 to be located tangentially to the fixed height of the tube 44. To accomplish this, the face plate 60 is mounted so as to be capable of being raised or lowered along with all of the bend head components it supports. This is accomplished by providing machined ways 290 in the upright supports 292 on each side of the front support structure 14. The sides of the face plate 60 are slidably recieved within the machine ways 290. A jack 294 is mounted at one end of the bottom face plate 28 (which is fixed between the upright supports 292) and at the other end to a bracket 296 fixed to the face plate 60, so that the face plate 60 and entire bend head 16 are supported by the jack 294. The bend head 16 can thus be raised or lowered to the required height by extending or retracting the jack 294.

Operation of the bend head 16 is thus as follows. One of the two bending positions 46,48 is chosen depending upon the intended configuration of the bent tube 44 as previously discussed. The bend arm 64 and an appropriate bend die 62 are mounted on the selected end 194,196 of the bend shaft 190 and the pressure die assembly 66 is mounted to the holder 68 beneath that end 194, 196. Appropriate clamp and pressure dies 222,280 are mounted thereon. The face plate 60 and entire bend head 16 are raised or lowered by the hydraulic jack 294 so that the tube 44 will be tangential to the groove 244 of the selected bend die 62. The carriage 40 is advanced until the tube 44 is located in the proper position in the bend head 16 for bending.

When the tube 44 is properly located, known draw bending procedures may be followed. The clamp die hydraulic cylinder 218 is pressurized to move the clamp die 222 against the tube 44, squeezing it against the bend die 62. The pressure die hydraulic cylinder 274 is pressurized so that the pressure die 280 is also moved up against the tube 44. The actuator 130 is retracted to release the tube 44 from the collet 42. The central hydraulic cylinder 204 is pressurized to pull the rack 202 down, driving the gear 200 to turn the bend shaft 190, and thus the bend die 62 and bend arm 64, through the desired angle of bend. The tube 44 is drawn around the bend between the clamp die 222 and the bend die 62 while the pressure die 280 maintains the horizontal alignment of the back portion of the tube 44.

When the bend is completed, the pressure and clamp dies 280,222 are released and the bend arm 64 and bend die 62 are pivoted back to the original position by driving the rack 202 up. The actuator 130 is moved outwardly to bias the collet fingers so that the tube 44 is again grasped in the collet 42. The ball screw 22 and square shaft 24 may then be driven to drive the carriage 40 and advance and rotate the tube 44 as needed to position it for its next bend.

When a different tube configuration is selected which requires that the other bend position 48,46 be used in order to avoid machine interference, the bend arm 64 and pressure die assembly 66 may be detached from the first bending position 46 and then manually mounted to the other side of the machine 10 by the operator (in the position shown in phantom in FIGS. 1 and 8). The hydraulic cylinders 218,274 of the bend arm 64 and pressure die assembly 66 are operated by hydraulic fluid which is supplied via flexible tubes (not shown) operated by the control unit. Flexible tubes permit the bend arm 64 and pressure die assembly 66 to be moved from one side of the machine 10 to the other as described. Accordingly, only one set of many of the working components of the bend head (such as the bend arm and the pressure die assembly) need be provided with the machine while still allowing for dual bend head operation. Accordingly, the advantages of dual head bending may be obtained while still providing an inexpensive machine.

Other aspects, objects and advantages of the present invention can be obtained from a study of the drawings, the specification and the appended claims.

We claim:

1. In a tube bending machine including a longitudinal base and a dual bend head supported by said base and permitting bending of a tube by either a first or second bend assembly, a carriage assembly comprising:

a carriage body fixed to a nut, said body including rotatable means for grasping a tube;

a screw rotatably supported longitudinally on said base and extending through said nut;

a rotatable shaft laterally fixed to but longitudinally slidable with respect to said carriage body, said shaft being drivably connected to said rotatable means;

means for fixing said shaft to said base in either a first or a second position to present a grasped tube to either the first or second bend assembly respectively;

means for rotating said screw; and means for rotating said shaft.

2. The carriage assembly of claim 1, wherein said carriage body pivots between said first and second positions about said screw, said pivot angle being less than 90°.

3. The carriage assembly of claim 2, wherein said carriage body pivots no more than 30° from a vertical plane in either said first or second positions.

4. The carriage assembly of claim 1, wherein the center of gravity of said carriage body is vertically aligned with said screw when said carriage is midway between said first and second positions.

5. The carriage assembly of claim 1, wherein said shaft drive means includes:

a motor for rotating a first sprocket, said first sprocket being equidistant from said first and second positions;

a second sprocket fixed to said shaft; and chain means drivably connecting said first and second sprockets.

6. The carriage assembly of claim 1, wherein said shaft is square in cross-section.

7. The carriage assembly of claim 1, further comprising:

brackets on both ends of said shaft, said shaft being rotatably journaled within said brackets; and releasable means for locking said brackets to said machine base with said shaft in either said first or said second position.

8. The carriage assembly of claim 7, wherein said locking means comprises:

first and second transverse beams fixed to said base, each beam being associated with one of said brackets and having on opposite ends a structure associated with the first and second positions respectively; and means for fixing the brackets to said structure on either end of the respective beams.

9. The carriage assembly of claim 8 wherein:

said structure comprises holes defined in said beams; and said fixing means comprises a pin associated with each bracket and receivable within the hole on either end of the associated beam.

10. The carriage assembly of claim 1, further comprising:

a plate supporting both of said bend assemblies and slidable within ways in the base in a plane perpendicular to the longitudinal direction; and means for supporting said plate in a plurality of positions with respect to said base to accomodate a plurality of bend dies.

11. In a tube bending machine including a longitudinal base and a dual bend head supported by said base and permitting bending of a tube by either a first or second bend assembly, the carriage assembly comprising:

a carriage body having first, second and third longitudinal openings therethrough;

a rotatable tube grasping collet carried by said carriage body and aligned with said first opening;

a nut fixed with respect to said carriage body and aligned with said second opening;

a screw rotatably supported laterally on said machine base and through said second opening and said nut;

a rotatable shaft drivably connected to said rotatable collet and slidably extending through said third opening;

means for laterally securing said shaft in either a first position locating said collet for left-hand bending or a second position locating said collet for right-hand bending;

drive means for rotating said screw; and drive means for rotating said shaft.

12. The carriage assembly of claim 11, wherein said carriage body pivots between said first and second positions about said screw, said pivot angle being less than 90°.

13. The carriage assembly of claim 12, wherein said carriage body pivots no more than 45° from a vertical plane in either said first or second positions.

14. The carriage assembly of claim 11, wherein the center of gravity of said carriage body is vertically aligned with said screw when said carriage is midway between said first and second positions.

15. The carriage assembly of claim 11, wherein said shaft drive means includes:

a motor for rotating a first sprocket, said first sprocket being vertically aligned with said screw;

a second sprocket fixed to said shaft; and chain means drivably connecting said first and second sprockets.

16. The carriage assembly of claim 11, wherein said shaft is square in cross-section.

17. The carriage assembly of claim 11, further comprising:

brackets on both ends of said shaft, said shaft being rotatably journaled within said brackets; and releasable means for locking said brackets to said machine base with said shaft in either said first or said second position.

18. The carriage assembly of claim 17, wherein said locking means comprises:

first and second transverse beams fixed to said base, each beam being associated with one of said brackets and having on opposite ends a structure associated with the first and second positions respectively; and means for fixing the brackets to said structure on either end of the respective beams.

19. The carriage assembly of claim 18 wherein:

said structure comprises holes defined in said beams; and said fixing means comprises a pin associated with each bracket and receivable within the hole on either end of the associated beam.

20. The carriage assembly of claim 11, further comprising:

a plate supporting both of said bend assemblies and slidable within ways in the base in a plane perpendicular to the longitudinal direction; and means for supporting said plate in a plurality of positions with espect to said base to accomodate a plurality of bend dies.

* * * * *